US011473769B2

(12) United States Patent
Howard

(10) Patent No.: US 11,473,769 B2
(45) Date of Patent: Oct. 18, 2022

(54) ILLUMINATED TOP FURNITURE

(71) Applicant: Ace Bayou Corp., Kenner, LA (US)

(72) Inventor: Bryan Howard, Bentonville, AR (US)

(73) Assignee: Ace Bayou Corp., Kenner, LA (US)

( * ) Notice: Subject to any disclaimer, the term of this patent is extended or adjusted under 35 U.S.C. 154(b) by 0 days.

(21) Appl. No.: 17/517,314

(22) Filed: Nov. 2, 2021

(65) Prior Publication Data

US 2022/0136692 A1 May 5, 2022

Related U.S. Application Data

(60) Provisional application No. 63/108,615, filed on Nov. 2, 2020.

(51) Int. Cl.

| | |
|---|---|
| ***F21S 6/00*** | (2006.01) |
| ***F21V 33/00*** | (2006.01) |
| ***F21V 3/00*** | (2015.01) |
| *F21Y 103/10* | (2016.01) |

(52) U.S. Cl.

CPC ..... *F21V 33/0012* (2013.01); *F21V 3/00* (2013.01); *F21S 6/002* (2013.01); *F21S 6/005* (2013.01); *F21Y 2103/10* (2016.08)

(58) Field of Classification Search

CPC . F21V 33/0012; F21V 3/00; F21S 6/00; F21S 6/003; F21S 6/005; F21S 6/002; A47B 13/12

See application file for complete search history.

(56) References Cited

U.S. PATENT DOCUMENTS

| | | | | |
|---|---|---|---|---|
| 10,101,521 | B1 * | 10/2018 | Burgio, Jr. | A47B 13/12 |
| 2008/0291659 | A1 * | 11/2008 | Huang | F21V 33/0012 362/97.1 |
| 2012/0020112 | A1 * | 1/2012 | Fisher | F21V 33/0012 362/127 |
| 2022/0061519 | A1 * | 3/2022 | Yang | A47B 13/12 |

* cited by examiner

*Primary Examiner* — Y M. Quach Lee

(74) *Attorney, Agent, or Firm* — Michael A. Bondi; Moss & Barnett

(57) ABSTRACT

Illuminated top furniture including an illuminated top portion and a support portion. The illuminated top portion includes a support layer, at least one light source, a light diffusion layer and an upper protective layer. The at least one light source is mounted to the support layer. The light diffusion layer is positioned on a side of the at least one light source that is opposite the support layer. The upper protective layer is positioned on a side of the light diffusion layer that is opposite the support layer. At least a portion of the upper protective layer is transparent such that light emitted by the at least one light source is visible through the upper protective layer while the light diffusion layer obscures the at least one light source so that the at least one light source is not visible through the upper protective layer. The support portion is attached to the illuminated top portion to support the illuminated top portion above a ground surface.

25 Claims, 4 Drawing Sheets

ILLUMINATED TOP FURNITURE

REFERENCE TO RELATED APPLICATION

This application claims priority to Provisional Applic. No. 63/108,615, filed on Nov. 2, 2020, the contents of which are incorporated herein by reference.

FIELD OF THE INVENTION

The invention relates generally to furniture. More particularly, the invention relates to illuminated top furniture.

BACKGROUND OF THE INVENTION

Video games are a popular form of entertainment for either playing the video games or watching other persons play the video games. An important aspect of the video games is the lights and sounds emitted while the video games are being played. The lights and sounds enhance a desire of the persons to play the video games or watch others play the video games.

SUMMARY OF THE INVENTION

An embodiment of the invention is directed to illuminated top furniture that includes an illuminated top portion and a support portion. The illuminated top portion includes a support layer, at least one light source, a light diffusion layer and an upper protective layer. The least one light source is mounted to the support layer. The light diffusion layer is positioned on a side of the at least one light source that is opposite the support layer. The upper protective layer is positioned on a side of the light diffusion layer that is opposite the support layer. At least a portion of the upper protective layer is transparent such that light emitted by the at least one light source is visible through the upper protective layer while the light diffusion layer obscures the at least one light source so that the at least one light source is not visible through the upper protective layer. The support portion is attached to the illuminated top portion to support the illuminated top portion above a ground surface.

Another embodiment of the invention is directed to an immersive gaming system that includes a video gaming system and illuminated top furniture. The illuminated top furniture includes an illuminated top portion and a support portion. The illuminated top portion includes a support layer, at least one light source, a light diffusion layer and an upper protective layer. The at least one light source is mounted to the support layer. Illumination of the at least one light source is operatively linked to the video gaming system. The light diffusion layer is positioned on a side of the at least one light source that is opposite the support layer. The upper protective layer is positioned on a side of the light diffusion layer that is opposite the support layer. At least a portion of the upper protective layer is transparent such that light emitted by the at least one light source is visible through the upper protective layer while the light diffusion layer obscures the at least one light source so that the at least one light source is not visible through the upper protective layer. The support portion is attached to the illuminated top portion to support the illuminated top portion above a ground surface.

Another embodiment of the invention is directed to a method of using illuminated top furniture. Illuminated top furniture is provided that includes an illuminated top portion and a support portion. The illuminated top portion includes a support layer, at least one light source, a light diffusion layer and an upper protective layer. The at least one light source is mounted to the support layer. The light diffusion layer is positioned on a side of the at least one light source that is opposite the support layer. The upper protective layer is positioned on a side of the light diffusion layer that is opposite the support layer. At least a portion of the upper protective layer is transparent. The support portion is attached to the illuminated top portion to support the illuminated top portion above a ground surface. Light is emitted from the at least one light source. the at least one light source is obscured with the light diffusion layer so that the at least one light source is not visible through the upper protective layer.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
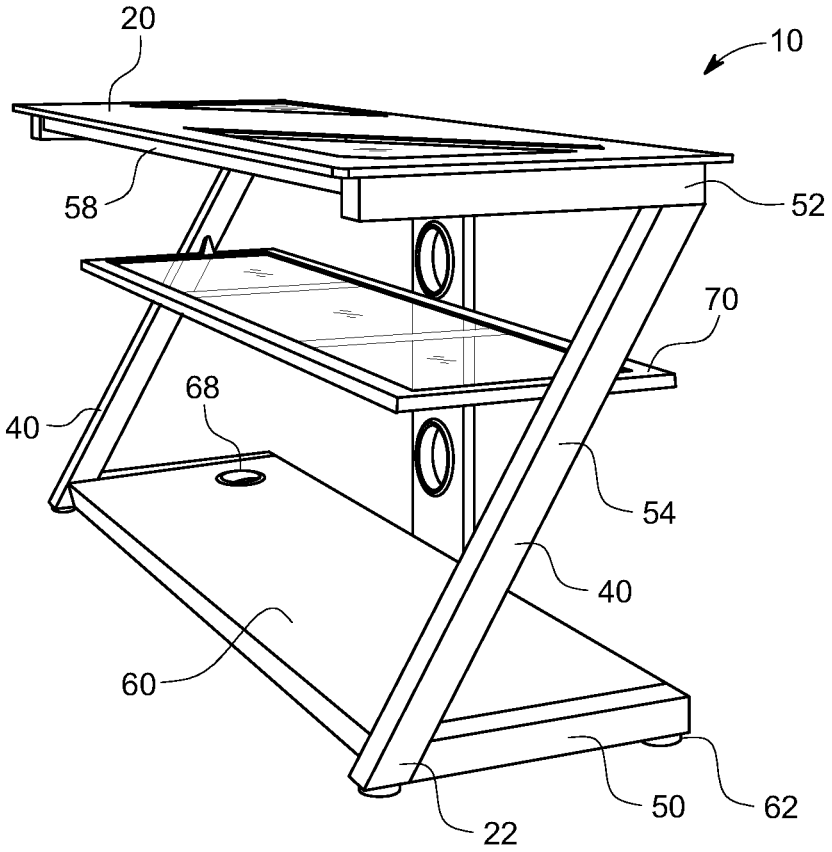
FIG. 1 is a front perspective view of illuminated top furniture according to an embodiment of the invention that is adapted for use as a television stand.
Figure 2:
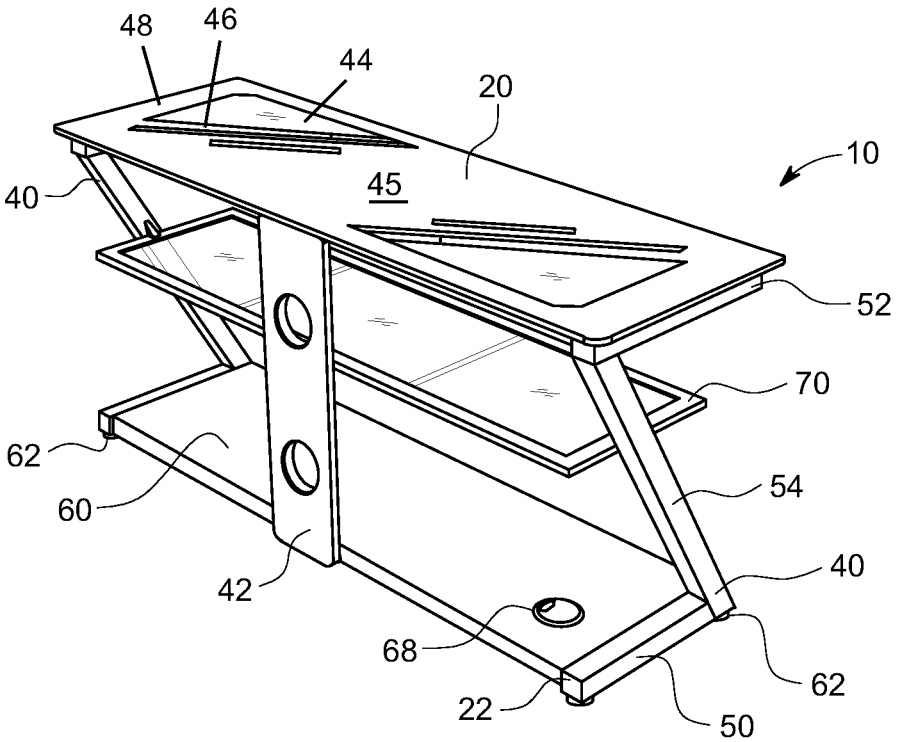
FIG. 2 is a back perspective view of the illuminated top furniture of FIG. 1.

An embodiment of the invention is directed to illuminated top furniture such as illustrated at 10 in FIGS. 1 and 2. This embodiment of the illuminated top furniture 10 is particularly suited for use as a television stand that is capable of supporting a television placed thereon. The illuminated top furniture 10 generally includes an illuminated top portion 20 and a base portion 22.

The illuminated top furniture 10 may be used in conjunction with another object such as a video gaming system such that the illuminated top furniture 10 may be illuminated in conjunction with aspects of the video game. The illuminated top furniture 10 thereby increases an immersiveness while a person is playing video games or watching other persons play the video games.

While it is desired for the light from the illuminated top furniture 10 to increase the immersiveness while the person is using the illuminated top furniture 10 when playing video games, it is also desirable for the light from the illuminated top furniture 10 to not visually distract the person who is using the illuminated top furniture 10 when playing video games from the person's visual focus on the video display on which the video game being played is displayed.

The same benefit applies to persons who are watching the person play video games while using the illuminated top furniture 10 because the light from the illuminated top furniture 10 is diffused through the light diffusing layer 26 so that the light appears to be emitted by a single continuous light source. Viewed another way, the light diffusing layer 26 obscures individual light sources.

In contrast, the persons watching the playing of the video games are likely to be distracted if the light from the illuminated top furniture 10 was not diffused but rather was sharp images such as are displayed on conventional video displays such as are used to display the video games being played while using the illuminated top furniture 10.

Figure 3:
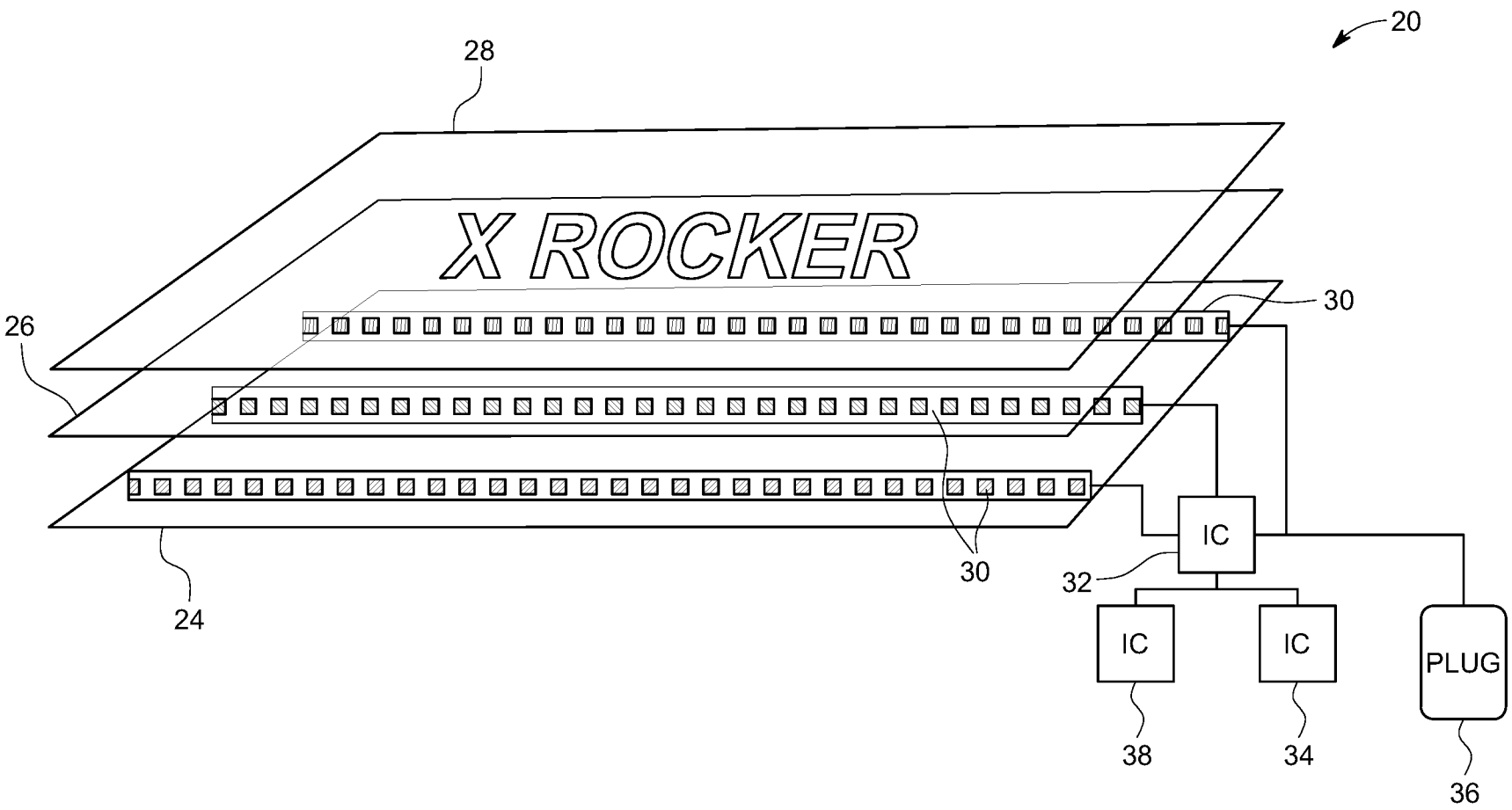
FIG. 3 is a schematic view of an illuminated top for the illuminated top furniture.

The illuminated top portion 20 includes several layers, which are illustrated in FIG. 3, utilizing the concepts of the invention. A support layer 24 is a lowest layer of the illuminated top portion 20 and serves as the structure to which the other components in the illuminated top portion 20 are mounted. The support layer 24 may be fabricated from a relatively rigid material such as an MDF board.

Light sources 30 are mounted to the support layer 24. In certain embodiments, there are separate blue, red and green light sources 30 as illustrated in FIG. 3. The light sources 30 may be positioned in certain regions of the illuminated top portion 20 or the light sources 30 may be positioned to substantially extend over nearly an entire surface of the illuminated top portion 20. In other embodiments, there may be a border around the edge of the illuminated top portion 20 that does not have any light sources 30.

While it is illustrated that there is only one line each of the blue, red and green light sources 30, a person of skill in the art will appreciate that the light sources 30 may have a variety of configuration using the concepts of the invention.

A person of skill in the art will appreciate that the light sources 30 may assume a variety of configurations using the concepts of the invention. An example of one suitable material for the light sources 30 are LEDs.

As illustrated in FIG. 3, the light sources 30 utilized used in this invention are spaced-apart from each other. As used herein, spaced-apart distinguishes the light sources 30 from the light sources used in a conventional video display such as a television. The spaced-apart light sources 30 are suited for use in conjunction with this invention because the light sources 30 are not used to display an image such as is done in a conventional video display. Rather, the function of the light sources 30 is to illuminate in at least one color that is visible through the illuminated top portion 20.

The illuminated top furniture 10 provides a significantly reduced lighting resolution as compared to conventional video displays, this reduced lighting resolution provides a reduced cost in fabricating the illuminated top furniture 10 as compared to the cost of fabricating a conventional video display having a similar size.

A light diffusing layer 26 is positioned over the light sources 30. The light diffusing layer 26 may be similar to the structures found in conventional LED televisions. The light diffusing layer 26 spreads light from the light sources 30 in an even and equal manner to reduce the appearance of each individual light source 30 to create an even light effect without hot spots so that the light appears to be emitted by a single continuous light source. In certain embodiments, the light diffusing layer 26 has a shape and a size that are similar to a shape and a size of the support layer 24.

Using the light diffusing layer 26 in conjunction with the spaced-apart light sources 30 makes the light from the spaced-apart light sources 30 to appear as being emitted from a single continuous light source. The invention thereby enhances the lighting quality at a considerably lower cost as compared to conventional LED televisions.

An upper protective layer 28 is positioned over the light diffusing layer 26. In certain embodiments, at least a portion of the upper protective layer 28 that is positioned over the light sources 30 may be at least partially light transmissive. In certain embodiments, the upper protective layer 28 includes at least one region that is light transmissive 44 and at least one region that is not light transmissive 45. An example of one material that may be used for the upper protective layer 28 is glass and in particular tempered glass. In certain embodiments, the upper protective layer 28 has a shape and a size that are similar to the shape and the size of the support layer 24.

The upper protective layer 28 may have a generally solid color in the at least one region that is not light transmissive 44. A logo and/or a trademark may be provided on the upper protective layer 28 such as using printing, stenciling or etching. The logo and/or trademark may allow light from the light sources 30 to pass therethrough such as to enhance the ability to see the logo and/or trademark.

A protective border (not shown) may be positioned at least partially around an edge of the illuminated top portion 20 to protect the components in the illuminated top portion 20 from damage while the illuminated top furniture 10 is being used. The protective border may be fabricated from a variety of materials using the concepts of the invention. Examples of two such materials that may be used for the protective border are metal and wood.

Another aspect of the invention relates to the positioning of the at least one light transmissive region 44. The upper protective layer 28 may include a border 48 than extends around the edge of the illuminated top portion 20 thereof that is not light transmissive. In certain embodiments, the border 48 along each edge has a width that is between about 10 percent and about 20 percent of the edge from which the border 48 extends to an opposite edge. Using such a configuration not only reduces the amount of the light sources 30 that are used in the illuminated top portion 20 but also enables a support (not shown) to be used beneath the upper protective layer 28 to increase a strength of the upper protective layer 28.

In certain embodiments, the upper protective layer 28 includes one of the at least one light transmissive regions 44 that occupies less than about 50 percent of the illuminated top portion 20. In other embodiments, the at least one light transmissive region 44 occupies between about 20 percent and about 40 percent of the illuminated top portion 20. In such configurations, the light transmissive region 44 may be positioned adjacent to the border 48 proximate one of the corners of the illuminated top portion 20 such as illustrated in FIGS. 1 and 2.

In other embodiments, there may be two of the light transmissive regions 44 that are positioned proximate opposite corners of the illuminated top portion 20. For example, one of the light transmissive regions 44 may be positioned proximate a lower right corner of the illuminated top portion 20 and one of the light transmissive regions 44 may be positioned proximate an upper left corner of the illuminated top portion 20 such as illustrated in FIG. 2. This configuration may be particularly useful where the illuminated top portion 20 has a relatively large size such as when the illuminated top furniture 10 is a desk.

In configurations where the upper protective layer 28 includes one light transmissive region 44, this light transmissive region 44 may include at least one not light transmissive area 46 provided therein as illustrated in FIG. 2. This not light transmissive area 46 may have an area that is significantly smaller than the overall area of the light transmissive region 44. In certain embodiments, the not light transmissive area 46 may be between about 10 percent and about 20 percent of the size of the light transmissive region 44.

While the illuminated top portion 20 is described with respect to the light transmissive region 44 and the not light transmissive region 45 being formed in the upper protective layer 28, it is possible for at least one of the light transmissive region 44 and the not light transmissive region 45 to be formed in the light diffusing layer 26.

Another advantage of forming the upper protective layer 28 that includes the light transmissive region 44 that occupies less than about 50 percent of the illuminated top portion 20 is that the not light transmissive region 45 occupies greater than about 50 percent of the illuminated top portion 20. Providing the not light transmissive region 45 with this size enhances the ability of the person using the illuminated top furniture 10 to perform other tasks on the not light transmissive region 45 where the light may interfere with the tasks such as reading text or viewing images on a piece of paper. Alternatively or additionally, the not light transmissive region 45 may be used to position things being used by the person playing the video game such as a keyboard or a mouse (not shown).

The light sources 30 may be operably connected to an integrated controller 32. The integrated controller 32 controls the operation of the light sources 30 such as turning on and off the light sources 30. The integrated controller 32 may also control a brightness level of the light sources 30, an illumination color of the light sources 30 and/or an illumination pattern of the light sources 30.

A power switch 34 may be provided on the illuminated top furniture 10 to turn on and off the light sources 30. The power switch 34 may be mounted at a location on the illuminated top portion 20 and/or the base portion 22 that is readily accessible by persons who are using the illuminated top furniture 10.

A power cord and plug 36 may be provided on the illuminated top furniture 10 to connect the illuminated top furniture 10 to an external power source such as an electrical outlet (not shown). In other embodiments, the operation of the illuminated top furniture 10 may be powered by batteries. While the batteries enable the illuminated top furniture 10 to be used without connection to the external power source, the batteries need to be periodically recharged or replaced.

The illuminated top furniture 10 may also include an electronic receiver 38 such as an infrared receiver The electronic receiver 38 enables the operation of the light sources 30 to be controlled such as using a remote control (not shown) or by connection to a video gaming system (not shown). The remote control may be used to control the light source illumination color, intensity and/or illumination pattern. A person of skill in the art will appreciate that there are a variety of protocols that may be used to send electronic control data to the electronic receiver 38 utilizing the concepts of the invention. Alternatively or additionally, the illuminated top furniture 10 may include a switch or other control that is mounted thereto to control operation of the light sources 30.

Figure 4:
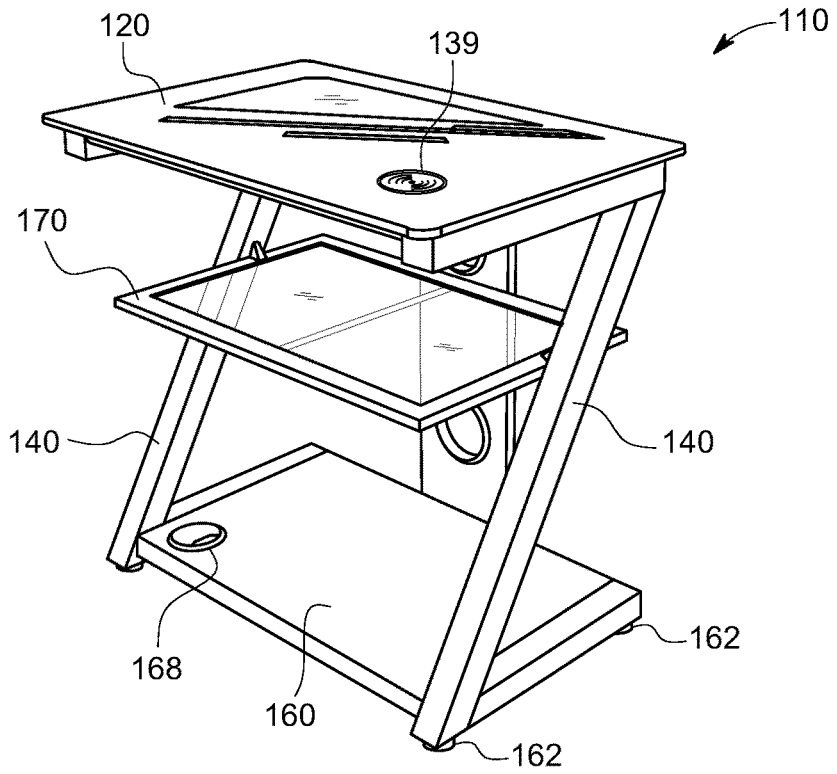
FIG. 4 is a front perspective view of an alternative embodiment of the illuminated top furniture that is adapted for use as an end table.
Figure 5:
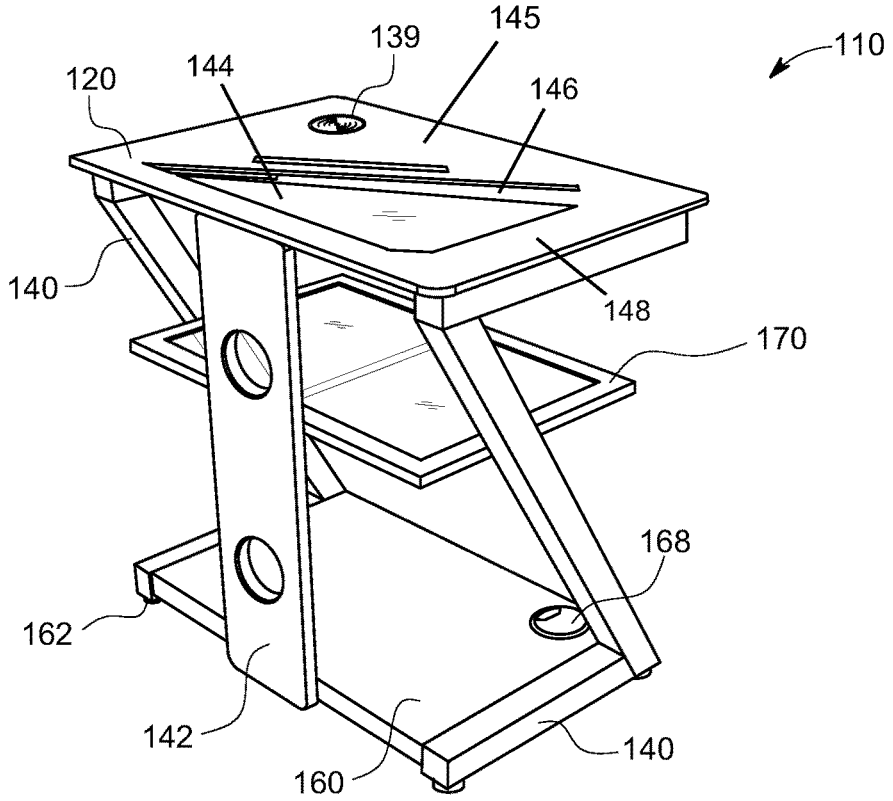
FIG. 5 is a back perspective view of the illuminated top furniture of FIG. 4.

While not illustrated in FIGS. 1 and 2, the illuminated top furniture 10 may include a charging source that is similar to the charging source 139 illustrated in FIGS. 4 and 5. The charging source may be used for wireless charging electronic devices such as mobile phones.

The base portion 22 supports the illuminated top portion 20 a distance above a support surface. In certain embodiments, the base portion 22 may include at least one end support 40. In other embodiments, there are two end supports 40 provided proximate opposite ends of the illuminated top portion 20.

An important feature of the at least one end support 40 is that the at least one end support 40 has sufficient strength to support the object or objects that are anticipated to be placed on the illuminated top furniture 10 during use. An example of one such item that will be placed on the illuminated top furniture 10 is a television (not shown).

The at least one end support 40 may have a variety of configurations using the concepts of the invention. In one such configuration, each of the at least one end support 40 is in the shape of the letter Z that includes a lower support element 50, an upper support element 52 and an intermediate support element 54 that extends between a front end of the lower support element 50 and a back end of the upper support element 52.

The lower support element 50 and the upper support element 52 may be formed with a similar length. The intermediate support element 54 is formed with a length based upon an intended height of the illuminated top furniture 10.

At least a portion of the lower support element 50, the upper support element 52 and the intermediate support element 54 may be formed with a generally square profile. Using such a profile provides the end support 40 with sufficient strength to not bend, deform or break when the object such as the television is placed on the illuminated top furniture 10. The end supports 40 may be fabricated from a variety of materials using the concepts of the invention. An example of on suitable material for fabricating the end supports 40 is metal.

At least one foot 62 may be placed under each end support 40. The foot 62 may be used for leveling the illuminated top furniture 10. Alternatively or additionally, the at least one foot 62 may have an enhanced friction.

The base portion 22 may also include a lower base panel 60 having a generally rectangular shape with a width that is approximately equal to a distance between the end supports 40. The lower base panel 60 may have a depth that is similar to a length of the lower support elements 50.

A variety of materials may be used to fabricate the lower base panel 60 using the concepts of the invention. An example of one suitable material for fabricating the lower base panel 60 is an MDF board. An upper surface of the lower base panel 60 may be finished to enhance a durability and/or an aesthetic appeal of the illuminated top furniture 10. An example of one suitable finish for the lower base panel 60 is a veneer that is applied to an upper surface of the lower base panel 60. The veneer may also be applied to at least a portion of edges of the lower base panel 60. An example of one such material that may be used to fabricate the veneer is carbon fiber.

The lower base panel 60 may be mounted to the end portion 40 proximate a lower end thereof. The lower base panel 60 having the preceding characteristics may increase the structural rigidity of the base portion 22. The lower base panel 60 may also provide a location on which objects such as decorations may be placed.

The illuminated top furniture 10 may include at least one power source 68 that may be used to power the operation of electronic components that are used in conjunction with television or by persons who are watching the television. For example, the power source 68 may include at least one USB plug receptacle. Alternatively or additionally, the power source 68 may include a conventional electrical outlet alone or in conjunction with a surge suppressor.

The power source 68 may be provided on the illuminated top furniture 10 at a location that is readily accessible. An example of one such location for the power source 68 is mounted in the lower base panel 60. In certain embodiments, an upper surface of the power source 68 may be approximately aligned with an upper surface of the lower base panel 60. Such a configuration minimizes the potential of damage to the power source 68 when using the illuminated top furniture 10. This configuration of the power source 68 may also cause the power source to not detract from the aesthetics of the illuminated top furniture 10.

In other embodiments, the base portion 22 further includes an intermediate support 42. The intermediate support 42 may be oriented in a vertical direction and extend between the illuminated top portion 20 and the lower base panel 60 and be mounted approximately intermediate the end supports 40. The intermediate support 42 may be mounted proximate a back edge of the illuminated top portion 20.

The base portion 20 may also include an upper stabilizer 58 that extends between the end supports 40. The upper stabilizer 58 may reduce swaying or shifting of the illuminated top furniture 10 during use.

The base portion 22 may also include at least one intermediate shelf 70 that is positioned between the illuminated top 20 and the lower base panel 60. In certain embodiments, the at least one intermediate shelf 70 has a length that is similar to a distance between the end supports 40. The intermediate shelf 70 may have a depth that is similar to a depth of the lower base panel 60.

The intermediate shelf 70 may be fabricated from a variety of materials using the concepts of the invention. In one such embodiment, the intermediate shelf 70 include a frame that extends around an outside thereof and a mesh that extends over the frame. The frame and the mesh may be fabricated from a rigid material that resists deformation in use. An example of one suitable material for the frame and the mesh is metal.

The illuminated top furniture 10 may also include at least one speaker (not shown) and at least one vibration mechanism (not shown) that are operably attached to the integrated controller 32 such that the at least one speaker and the at least one vibration mechanism may be activated in conjunction with the lights in the illuminated top furniture 10.

Another embodiment of the invention is directed to illuminated top furniture such as illustrated at 110 in FIGS. 4 and 5. This embodiment of the illuminated top furniture 110 is particularly suited for use as a side table. The illuminated top furniture 110 generally includes an illuminated top portion 120 and a base portion 122.

The illuminated top portion 120 may have a structure that is similar to the illuminated top portion 20 described above with respect to FIG. 3. The operation of the illuminated top portion 120 may be similar to the operation of the illuminated top portion 20 described above with respect to FIG. 3.

The illuminated top portion 120 includes at least one light transmissive region 144 and at least one not light transmissive region 145. Similar to the embodiment illustrated in FIG. 2, the at least one light transmissive region 144 has at least one not light transmissive area 146 where the at least one light transmissive region 144 is proximate at least one of the borders 148 where the configuration of the at least one light transmissive region, the at least one not light transmissive area 146 and the border 148 are similar to the corresponding structures of the embodiment illustrated in FIGS. 1-3.

While the illuminated top portion 120 is described with respect to the light transmissive region 144 and the not light transmissive region 145 being formed in the upper protective layer, it is possible for at least one of the light transmissive region 144 and the not light transmissive region 145 to be formed in the light diffusing layer.

FIGS. 4 and 5 illustrate that a charging source 139 may be associated with the illuminated top portion 120. An example of one configuration of the charging source 139 is a wireless charger. The charging source 139 may be integrated into the illuminated top portion 120 so that the charging source 139 is no higher than an upper surface of the illuminated top portion 120. In certain embodiments, the charging source 139 is positioned below the upper surface of the illuminated top portion 120 and is accessible through the upper surface of the illuminated top portion 120. In such a configuration, an identifier may be placed on the upper surface of the illuminated top portion 120 to notify persons who are using the illuminated top furniture 110 of the presence and/or location of the charging source 139.

The base portion 122 supports the illuminated top portion 120 a distance above a support surface. In certain embodiments, the base portion 122 may include at least one end support 140. In other embodiments, there are two end supports 140 provided proximate opposite ends of the illuminated top portion 120.

An important feature of the at least one end support 140 is that the at least one end support 140 has sufficient strength to support the object or objects that are anticipated to be placed on the illuminated top furniture 110 during use. An example of one such item that will be placed on the illuminated top furniture 110 is a light (not shown).

The at least one end support 140 may have a variety of configurations using the concepts of the invention. In one such configuration, each of the at least one end support 140 is in the shape of the letter Z that includes a lower support element 150, an upper support element 152 and an intermediate support element 154 that extends between a front end of the lower support element 150 and a back end of the upper support element 152.

The lower support element 150 and the upper support element 152 may be formed with a similar length. The intermediate support element 154 is formed with a length based upon an intended height of the illuminated top furniture 110.

At least a portion of the lower support element 150, the upper support element 152 and the intermediate support element 154 may be formed with a generally square profile. Using such a profile provides the end support 140 with sufficient strength to not bend, deform or break when the object such as the television is placed on the illuminated top furniture 110. The end supports 140 may be fabricated from a variety of materials using the concepts of the invention. An example of on suitable material for fabricating the end supports 140 is metal.

At least one foot 162 may be placed under each end support 140. The foot 162 may be used for leveling the illuminated top furniture 110. Alternatively or additionally, the at least one foot 162 may have an enhanced friction.

The base portion 122 may also include a lower base panel 160 having a generally rectangular shape with a width that is approximately equal to a distance between the end supports 140. The lower base panel 160 may have a depth that is similar to a length of the lower support elements 150.

A variety of materials may be used to fabricate the lower base panel 160 using the concepts of the invention. An example of one suitable material for fabricating the lower base panel 60 is an MDF board. An upper surface of the lower base panel 160 may be finished to enhance a durability and/or an aesthetic appeal of the illuminated top furniture 110. An example of one suitable finish for the lower base panel 160 is a veneer that is applied to an upper surface of the lower base panel 160. The veneer may also be applied to at least a portion of edges of the lower base panel 160. An example of one such material that may be used to fabricate the veneer is carbon fiber.

The lower base panel 160 may be mounted to the end portion 140 proximate a lower end thereof. The lower base panel 160 having the preceding characteristics may increase the structural rigidity of the base portion 122. The lower base panel 160 may also provide a location on which objects such as decorations may be placed.

The illuminated top furniture 110 may include at least one power source 168 that may be used to power the operation of electronic components that are used in conjunction with television or by persons who are watching the television. For example, the power source 168 may include at least one USB plug receptacle. Alternatively or additionally, the power source 168 may include a conventional electrical outlet alone or in conjunction with a surge suppressor.

The power source 168 may be provided on the illuminated top furniture at a location that is readily accessible. An example of one such location for the power source 168 is mounted in the lower base panel 160. In certain embodiments, an upper surface of the power source 168 may be approximately aligned with an upper surface of the lower base panel 160. Such a configuration minimizes the potential of damage to the power source 168 when using the illuminated top furniture 110. This configuration of the power source 168 may also cause the power source 168 to not detract from the aesthetics of the illuminated top furniture 110.

In other embodiments, the base portion 122 further includes an intermediate support 142. The intermediate support 142 may be oriented in a vertical direction and extend between the illuminated top portion 120 and the lower base panel 160 and be mounted approximately intermediate the end supports 140. The intermediate support 142 may be mounted proximate a back edge of the illuminated top portion 120.

The base portion 122 may also include at least one intermediate shelf 170 that is positioned between the illuminated top 120 and the lower base panel 160. In certain embodiments, the at least one intermediate shelf 170 has a length that is similar to a distance between the end supports 140. The intermediate shelf 170 may have a depth that is similar to a depth of the lower base panel 160.

The intermediate shelf 170 may be fabricated from a variety of materials using the concepts of the invention. In one such embodiment, the intermediate shelf 170 include a frame that extends around an outside thereof and a mesh that extends over the frame. The frame and the mesh may be fabricated from a rigid material that resists deformation in use. An example of one suitable material for the frame and the mesh is metal.

The illuminated top furniture 110 may also include at least one speaker (not shown) and at least one vibration mechanism (not shown) that are operably attached to the integrated controller such that the at least one speaker and the at least one vibration mechanism may be activated in conjunction with the lights in the illuminated top furniture 110.

Figure 6:
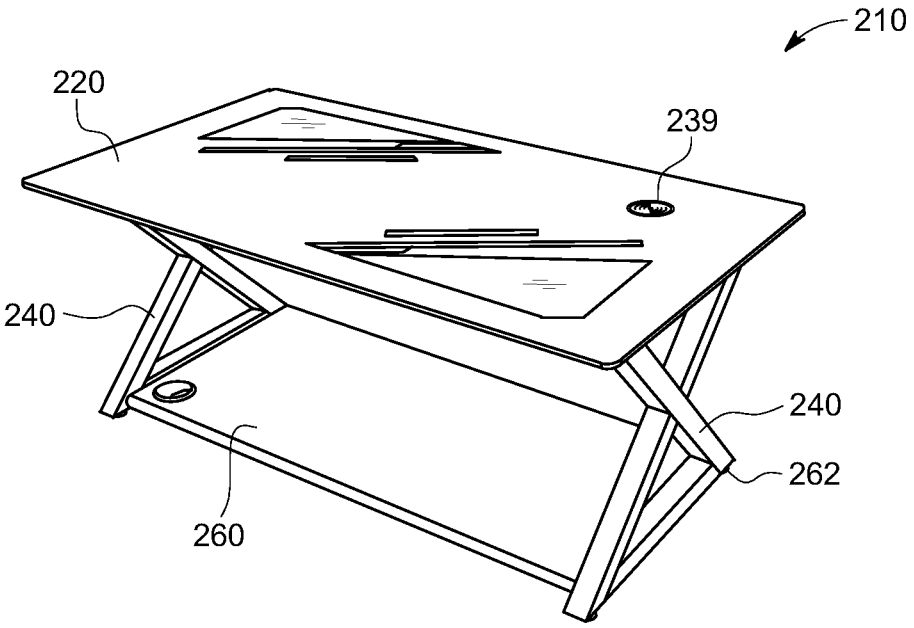
FIG. 6 is a front perspective view of an alternative embodiment of the illuminated top furniture that is adapted for use as a coffee table.
Figure 7:
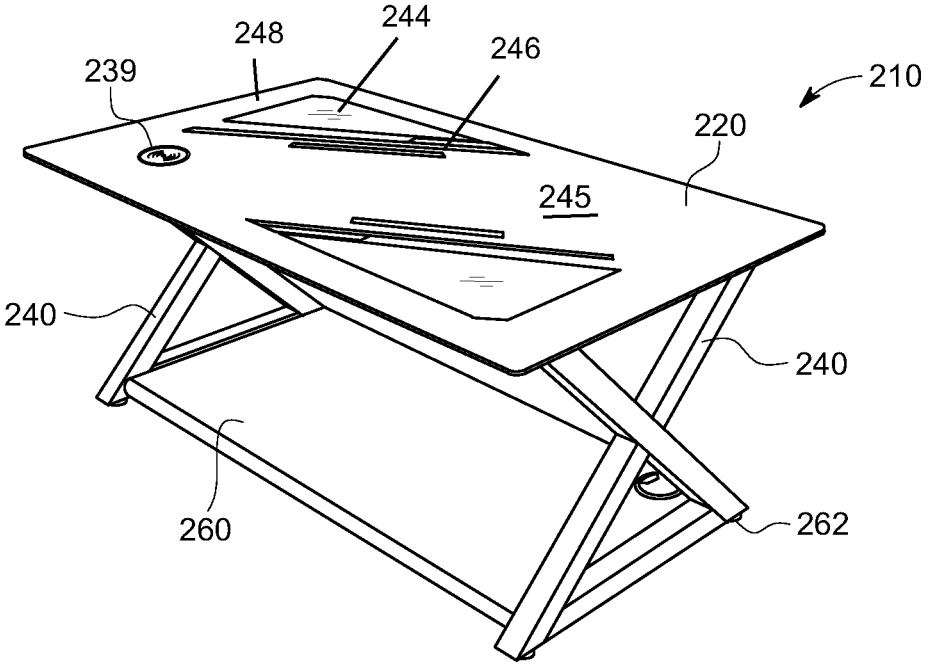
FIG. 7 is a back perspective view of the illuminated top furniture of FIG. 6.

An embodiment of the invention is directed to illuminated top furniture such as illustrated at 210 in FIGS. 6 and 7. This embodiment of the illuminated top furniture 210 is particularly suited for use as a coffee table. The illuminated top furniture 210 generally includes an illuminated top portion 220 and a base portion 222.

The illuminated top portion 220 may have a structure that is similar to the illuminated top portion 220 described above with respect to FIG. 3. The operation of the illuminated top portion 220 may be similar to the operation of the illuminated top portion 20 described above with respect to FIG. 3.

The illuminated top portion 220 includes at least one light transmissive region 244 and at least one not light transmissive region 245. Similar to the embodiment illustrated in FIG. 2, the at least one light transmissive region 244 has at least one not light transmissive area 246 where the at least one light transmissive region 244 is proximate at least one of the borders 248 where the configuration of the at least one light transmissive region, the at least one not light transmissive area 246 and the border 248 are similar to the corresponding structures of the embodiment illustrated in FIGS. 1-3.

While the illuminated top portion 220 is described with respect to the light transmissive region 244 and the not light transmissive region 245 being formed in the upper protective layer, it is possible for at least one of the light transmissive region 244 and the not light transmissive region 245 to be formed in the light diffusing layer.

FIGS. 6 and 7 illustrate that the illuminated top furniture 210 may include a charging source 239 that is associated with the illuminated top portion 220. An example of one configuration of the charging source 239 is a wireless charger. The charging source 239 may be integrated into the illuminated top portion 220 so that the charging source 239 is no higher than an upper surface of the illuminated top portion 220. In certain embodiments, the charging source 139 is positioned below the upper surface of the illuminated top portion 220 and is accessible through the upper surface of the illuminated top portion 220. In such a configuration, an identifier may be placed on the upper surface of the illuminated top portion 220 to notify persons who are using the illuminated top furniture 210 of the presence and/or location of the charging source 239.

The base portion 222 supports the illuminated top portion 220 a distance above a support surface. In certain embodiments, the base portion 222 may include at least one end support 240. In other embodiments, there are two end supports provided proximate opposite ends of the illuminated top portion 220.

An important feature of the at least one end support 240 is that the at least one end support 240 has sufficient strength to support the object or objects that are anticipated to be placed on the illuminated top furniture 210 during use.

The at least one end support 240 may have a variety of configurations using the concepts of the invention. In one such configuration, each of the at least one end support 240 includes a lower support element 250, an upper support element 252 and an X-shaped intermediate support element 254 that extends between the lower support element 250 and the upper support element 252.

The lower support element 250 and the upper support element 252 may be formed with a similar length. The intermediate support element 254 is formed with a length based upon an intended height of the illuminated top furniture 210.

At least a portion of the lower support element 250, the upper support element 252 and the intermediate support element 254 may be formed with a generally square profile. Using such a profile provides the end support 240 with sufficient strength to not bend, deform or break when the object such as the television is placed on the illuminated top furniture 210. The end supports 240 may be fabricated from a variety of materials using the concepts of the invention. An example of on suitable material for fabricating the end supports 240 is metal.

At least one foot 262 may be placed under each end support 240. The foot 262 may be used for leveling the illuminated top furniture 210. Alternatively or additionally, the at least one foot 262 may have an enhanced friction.

The base portion 222 may also include a lower base panel 260 having a generally rectangular shape with a width that is approximately equal to a distance between the end supports 240. The lower base panel 260 may have a depth that is similar to a length of the lower support elements 250.

A variety of materials may be used to fabricate the lower base panel 260 using the concepts of the invention. An example of one suitable material for fabricating the lower base panel 260 is an MDF board. An upper surface of the lower base panel 260 may be finished to enhance a durability and/or an aesthetic appeal of the illuminated top furniture 210. An example of one suitable finish for the lower base panel 260 is a veneer that is applied to an upper surface of the lower base panel 260. The veneer may also be applied to at least a portion of edges of the lower base panel 360. An example of one such material that may be used to fabricate the veneer is carbon fiber.

The lower base panel 260 may be mounted to the end portion 240 proximate a lower end thereof. The lower base panel 260 having the preceding characteristics may increase the structural rigidity of the base portion 222. The lower base panel 260 may also provide a location on which objects such as decorations may be placed.

The illuminated top furniture 210 may include at least one power source 268 that may be used to power the operation of electronic components that are used in conjunction with television or by persons who are watching the television. For example, the power source 268 may include at least one USB plug receptacle. Alternatively or additionally, the power source 268 may include a conventional electrical outlet alone or in conjunction with a surge suppressor.

The power source 268 may be provided on the illuminated top furniture at a location that is readily accessible. An example of one such location for the power source 268 is mounted in the lower base panel 260. In certain embodiments, an upper surface of the power source 268 may be approximately aligned with an upper surface of the lower base panel 260. Such a configuration minimizes the potential of damage to the power source 268 when using the illuminated top furniture 210. This configuration of the power source 268 may also cause the power source to not detract from the aesthetics of the illuminated top furniture 210.

The illuminated top furniture 210 may also include at least one speaker (not shown) and at least one vibration mechanism (not shown) that are operably attached to the integrated controller such that the at least one speaker and the at least one vibration mechanism may be activated in conjunction with the lights in the illuminated top furniture 210.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. Illuminated top furniture comprising:

an illuminated top portion comprising:

a support layer;

at least one light source mounted to the support layer;

a light diffusion layer positioned on a side of the at least one light source that is opposite the support layer; and an upper protective layer positioned on a side of the light diffusion layer that is opposite the support layer, wherein at least a portion of the upper protective layer is transparent such that light emitted by the at least one light source is visible through the upper protective layer while the light diffusion layer obscures the at least one light source so that the at least one light source is not visible through the upper protective layer, wherein the illuminated top portion comprises at least one light transmissive region and a not light transmissive region, wherein the at least one light transmissive region extends over less than about 50 percent of the illuminated top portion and wherein the not light transmissive region extends over greater than about 50 percent of the illuminated top portion; and a support portion that is attached to the illuminated top portion to support the illuminated top portion above a ground surface.

2. The illuminated top furniture of claim 1, wherein the at least one light transmissive region comprises at least one not light transmissive area having an area that is between about 10 percent and about 20 percent of an area of the at least one light transmissive region.

3. The illuminated top furniture of claim 1, wherein the at least one light transmissive region is formed in at least one of the upper protective layer and the light diffusion layer.

4. The illuminated top furniture of claim 1, wherein the light diffusion layer obscures light emitted from individual light sources in the at least one light source so that the light appears to be emitted by a single continuous light source.

5. The illuminated top furniture of claim 1, wherein the illuminated top portion further comprises a charging source that is capable of charging a battery in an electronic device.

6. The illuminated top furniture of claim 1, wherein the illuminated top portion comprises a first side edge and a second side edge that is opposite the first side edge, wherein the support portion comprises a first end support and a second end support, wherein the first end support is mounted proximate the first side edge and wherein second end support is mounted proximate the second side edge.

7. The illuminated top furniture of claim 1, wherein the illuminated top furniture is at least one of a desk, an end table, a coffee table and a television stand.

8. The illuminated top furniture of claim 1, wherein the illuminated top portion comprises a plurality of corners and wherein the at least one light transmissive region is positioned proximate one of the corners.

9. The illuminated top furniture of claim 8, wherein the at least one light transmissive region comprises a first light transmissive region and a second light transmissive region and wherein the first light transmissive region and the second light transmissive region are positioned proximate opposite corners of the illuminated top portion.

10. The illuminated top furniture of claim 1, wherein the at least one light transmissive region extends over between about 20 percent and 40 percent of the illuminated top portion.

11. An immersive gaming system comprising:
a video gaming system; and
illuminated top furniture comprising:
an illuminated top portion comprising:
a support layer;
at least one light source mounted to the support layer, wherein illumination of the at least one light source operatively linked to the video gaming system;
a light diffusion layer positioned on a side of the at least one light source that is opposite the support layer; and
an upper protective layer positioned on a side of the light diffusion layer that is opposite the support layer, wherein at least a portion of the upper protective layer is transparent such that light emitted by the at least one light source is visible through the upper protective layer while the light diffusion layer obscures the at least one light source so that the at least one light source is not visible through the upper protective layer, wherein the illuminated top portion comprises at least one light transmissive region and a not light transmissive region, wherein the at least one light transmissive region extends over less than about 50 percent of the illuminated top portion and wherein the not light transmissive region extends over greater than about 50 percent of the illuminated top portion; and
a support portion that is attached to the illuminated top portion to support the illuminated top portion above a ground surface.

12. The immersive gaming system of claim 11, wherein the at least one light transmissive region that extends over between about 20 percent and about 40 percent of the illuminated top portion and wherein the at least one light transmissive region is formed in at least one of the upper protective layer and the light diffusion layer.

13. The immersive gaming system of claim 11, wherein the at least one light transmissive region comprises at least one not light transmissive area having an area that is between about 10 percent and about 20 percent of an area of the at least one light transmissive region.

14. The immersive gaming system of claim 11, wherein the light diffusion layer obscures light emitted from individual light sources in the at least one light source so that the light appears to be emitted by a single continuous light source.

15. The immersive gaming system of claim 11, wherein the illuminated top portion further comprises a charging source that is capable of charging a battery in an electronic device.

16. The immersive gaming system of claim 11, wherein the illuminated top portion comprises a first side edge and a second side edge that is opposite the first side edge, wherein the support portion comprises a first end support and a second end support, wherein the first end support is mounted proximate the first side edge and wherein second end support is mounted proximate the second side edge.

17. The immersive gaming system of claim 11, wherein the illuminated top portion comprises a plurality of corners and wherein the at least one light transmissive region is positioned proximate one of the corners.

18. The immersive gaming system of claim 17, wherein the at least one light transmissive region comprises a first light transmissive region and a second light transmissive region and wherein the first light transmissive region and the second light transmissive region are positioned proximate opposite corners of the illuminated top portion.

19. A method of using illuminated top furniture comprising:
providing illuminated top furniture comprising an illuminated top portion and a support portion, wherein the illuminated top portion comprising a support layer, at least one light source, a light diffusion layer and an upper protective layer, wherein the at least one light source is mounted to the support layer, wherein the light diffusion layer is positioned on a side of the at least one light source that is opposite the support layer, wherein the upper protective layer is positioned on a side of the light diffusion layer that is opposite the support layer, wherein at least a portion of the upper protective layer is transparent, wherein the illuminated top portion comprises at least one light transmissive region and a not light transmissive region, wherein the at least one light transmissive region extends over less than about 50 percent of the illuminated top portion, wherein the not light transmissive region extends over greater than about 50 percent of the illuminated top portion and wherein the support portion is attached to the illuminated top portion to support the illuminated top portion above a ground surface;
emitting light from the at least one light source; and
obscuring the at least one light source with the light diffusion layer so that the at least one light source is not visible through the upper protective layer.

20. The method of claim 19, wherein the at least one light transmissive region comprises at least one not light transmissive area having an area that is between about 10 percent and about 20 percent of an area of the at least one light transmissive region.

21. The method of claim 19, wherein the at least one light transmissive region is formed in at least one of the upper protective layer and the light diffusion layer.

22. The method of claim 19, wherein the light diffusion layer obscures light emitted from individual light sources in the at least one light source so that the light appears to be emitted by a single continuous light source.

23. The method of claim 19, wherein the illuminated top portion comprises a first side edge and a second side edge that is opposite the first side edge, wherein the support portion comprises a first end support and a second end support, wherein the first end support is mounted proximate the first side edge and wherein second end support is mounted proximate the second side edge.

24. The method of claim 19, wherein the illuminated top portion comprises a plurality of corners and wherein the at least one light transmissive region is positioned proximate one of the corners.

25. The method of claim 24, wherein the at least one light transmissive region comprises a first light transmissive region and a second light transmissive region and wherein the first light transmissive region and the second light transmissive region are positioned proximate opposite corners of the illuminated top portion.

* * * * *